US005851580A

United States Patent [19]

Amberg et al.

[11] Patent Number: 5,851,580

[45] Date of Patent: Dec. 22, 1998

[54] SHOTCRETE SPRAYING PROCESS

[76] Inventors: Felix Amberg, Hinterbühlstrasse 5, CH-8307 Effretikon; Otto Tschumi, Spannerstrasse 5, CH-8500 Frauenfeld; Markus Vogel, In der Hohfurri 10, CH-8172 Niederglatt, all of Switzerland

[21] Appl. No.: 772,682

[22] Filed: Dec. 23, 1996

[30] Foreign Application Priority Data

Dec. 27, 1995 [CH] Switzerland ..... 03682/95

[51] Int. Cl.[6] ..... B05D 7/22; B05D 7/24

[52] U.S. Cl. ..... 427/8; 427/236; 118/712; 118/317; 118/DIG. 10

[58] Field of Search ..... 427/8, 236; 118/317, 118/DIG. 10, 712

[56] References Cited

U.S. PATENT DOCUMENTS 5,358,568 10/1994 Okano et al. ..... 118/317

FOREIGN PATENT DOCUMENTS 0 009 011 A1 3/1980 European Pat. Off. .
60-132667 7/1985 Japan .
63-141674 6/1988 Japan .

OTHER PUBLICATIONS

Patent Abstracts of Japan, vol. 12, No. 398 (C0538) of 21 Oct. 1988 (Hazama Gumi).

Patent Abstracts of Japan, vol. 12, No. 156 (P–701) of 13 May 1988 (Mitsui & Shipbuild).

Patent Abstracts of Japan, vol. 14, No. 52 (M–0928) of 30 Jan. 1990 (Komatsu).

WPI Database Section PQ, Week 9009 for WO 9001094 (Putzmeister–W Masch).

*Primary Examiner*—Katherine A. Bareford
*Attorney, Agent, or Firm*—Fish & Richardson P.C.

[57] ABSTRACT

A mobile shortcrete spraying apparatus has a spraying device which comprises a support arm able to move horizontally and vertically, a spray lance likewise movable, supported thereon, and at the end of the lance and rotatable with respect to the longitudinal axis of the lance a spray nozzle and a measuring probe. The measuring probe determines distance of the probe from a multiplicity of measuring points on a substrate to be sprayed, according to a predetermined grid pattern, and a control unit causes the spray nozzle to spray perpendicularly with respect to a plane defined by three such measuring points or a line defined by two measuring points.

13 Claims, 3 Drawing Sheets

SHOTCRETE SPRAYING PROCESS

The invention relates to a process and an apparatus for the batch-wise coating of the inside walls of tunnels with sprayable concrete.

In order to secure the rock of a tunnel abatement or to construct a lining layer, shotcrete (sprayed concrete) is often applied to the inside wall of the tunnel, and for isolation purposes a corresponding isolation layer is also applied. By the use of the term "tunnel abatement" is meant the free area which is broken out of a rock by blasting or cutting. The length of the abatement is dependent, inter alia, on the quality of the rock. In tunnel and gallery construction, the usual abatement lengths are between 1 and 6 meters.

Apparatus for spraying concrete is already known and such apparatus is used both in tunnel and gallery construction and to secure excavated pits and embankments. This known apparatus typically has a spray robot mounted on a carrier vehicle; the guidance of the spray nozzle when the shotcrete is applied to the surface to be treated is mechanised, and the operating safety and operating conditions for the construction worker is therefore improved.

Such apparatus preferably has a supporting arm which can be moved horizontally and vertically, and an extendable spray lance which is similarly freely movable and is attached to the arm. At one end, the lance bears the spray nozzle which is linked to a concrete feed pipe. The spray nozzle is attached to a swivel head which is movable about the axis of the spray lance, such that the centre of the jet of concrete leaving the spray nozzle can always be maintained at an optimum angle to the surface during the spraying operation. Control of all movable elements of the spray robot is effected by remote control, whereby routine movements, for example the horizontal movement of the spray lance, can be automated.

Various properties of a concrete layer applied to the inside surface of a tunnel or gallery, for example the compressive strength and the adhesive properties, depend greatly on the spray angle and on the spray distance. It is known that an optimum coating may be attained if the distance of the spray nozzle to the wall—depending on the type of rock—is preferably 1 to 2 m, and if the center of the concrete jet leaving the spray nozzle is as perpendicular as possible to the tunnel wall. If these parameters of the process are not observed, the proportion of rebounded material, that is, sprayed material which does not adhere to the wall and which is thus wasted, is disproportionately large. As a result, operating costs are increased, not only because of the unusable shotcrete, but also because of the necessity to remove it. In the end—if the above parameters of the process are not observed—the amount of concrete actually remaining on the inside wall of the tunnel after a spraying operation can no longer be determined because of the quantity of rebounded material which is difficult to determine and therefore is usually unknown.

An inside tunnel wall to be coated with shotcrete is normally of very uneven constitution. An essential disadvantage of the previously described apparatus is therefore that it is not always easy to align the spray nozzle exactly perpendicularly to the surface of the rock and to maintain an ideal distance from it. In addition, the thickness of the wall having a concrete layer applied by the known apparatus can no longer be determined as a result of the mostly uneven inside wall of the tunnel and the large amount of abrasion of material under some circumstances.

Finally, control of the spray lance and the optimum adjustment of the swivel head require a comparatively large number of complicated and time-consuming operations, which in practice can only be carried out with the cooperation of at least one person.

SUMMARY OF THE INVENTION

The invention is based on the problem of creating a process that does not have the disadvantages of the known process, and in particular enables the shotcrete to be applied rapidly and without any loss of material as far as possible during the batch-wise operation. This is achieved in the first instance by automatic observation of the correct spray angle and spray distance.

This problem is solved according to the invention by a process for the batch-wise coating of an inside surface of a tunnel section with concrete, comprising (a) a measuring phase, wherein a measuring probe measures the distance from the probe to the surface at a multiplicity of measuring points thereon according to a predetermined measuring grid, said measured distances being stored in a control unit; followed by (b) a spraying phase wherein concrete is sprayed on to the surface from a spray nozzle, the control unit adjusting the spray nozzle such that it remains at a predetermined distance from the surface, the center of the spray jet contacting the surface perpendicular either to a straight line joining two measuring points or to a plane defined by three measuring points.

In a preferred embodiment, the invention provides a process for the batch-wise coating of an inside surface of a tunnel section with concrete, wherein the sprayed concrete is sprayed by a spray nozzle on to the inside surface to be treated, and whereby the spray nozzle is mounted on an extendable spray lance of a spraying device which guides the spray nozzle the spray nozzle being rotatable about the longitudinal axis of the spray lance, characterised in that for each batch the profile of the tunnel section is measured by means of a measuring probe which is mounted on the spray lance of the device and is rotatable about the longitudinal axis of the lance, such that the distance of a measurement point on the tunnel surface to the measuring probe is measured at a multiplicity of points of the tunnel section in accordance with a predetermined measuring grid and this distance is stored by a control mechanism, the spray nozzle serving to apply shotcrete to the said tunnel section being guided by the control mechanism in such a way that the center of the jet of concrete leaving the spray nozzle is perpendicular to a straight line formed by two measured points or perpendicular to a plane formed by three measured points and the distance of the spray nozzle from the said straight line or area corresponds to a predetermined value.

The invention further provides a concrete spraying apparatus mounted on a vehicle and consisting of a spraying device which comprises a support arm, movable horizontally and vertically, and bearing a similarly movable spray lance at one end of which is a swivel head on which are rotatably mounted with respect to the longitudinal axis of the lance a spray nozzle and a measuring probe, the measuring probe being adapted to measure the distance from a substrate to be sprayed at a multiplicity of points according to a predetermined grid pattern, under the direction of a control unit which also stores the measured distances and then directs the spray nozzle such that the center of the jet of concrete from the nozzle is perpendicular either to a line formed by two measured points or to a plane formed by three measured points, the distance of the nozzle from the line or plane also being adjusted to correspond to a predetermined value.

The measuring probe preferably utilises an infra-red laser beam, but any other suitable means may be used, for example, ultrasonic scanning. In a preferred embodiment of the invention, the process comprises a measuring phase during which the whole geometry of the tunnel section (4) is measured, this being followed by a spray phase during which the concrete is sprayed on to the said tunnel section (4).

During the spraying operation the spray nozzle is preferably maintained at a distance of from 1 to 3 meters at right angles to the inside wall of the tunnel. The inside wall of the tunnel is preferably measured with a measuring grid of 0.1×0.1 meters to 1.0×1.0 meters, more preferably of 0.4×0.4 meters. Preferably, a tunnel section having a length of 1 to 6 meters is treated per batch.

In a further preferred embodiment of the invention, after the spraying operation, the profile of the tunnel section (4) is measured again in order to determine the thickness of the concrete layer applied.

The invention will now be illustrated with reference to the accompanying drawings which depict a preferred embodiment.

DESCRIPTION OF PREFERRED EMBODIMENTS

Figure 1:
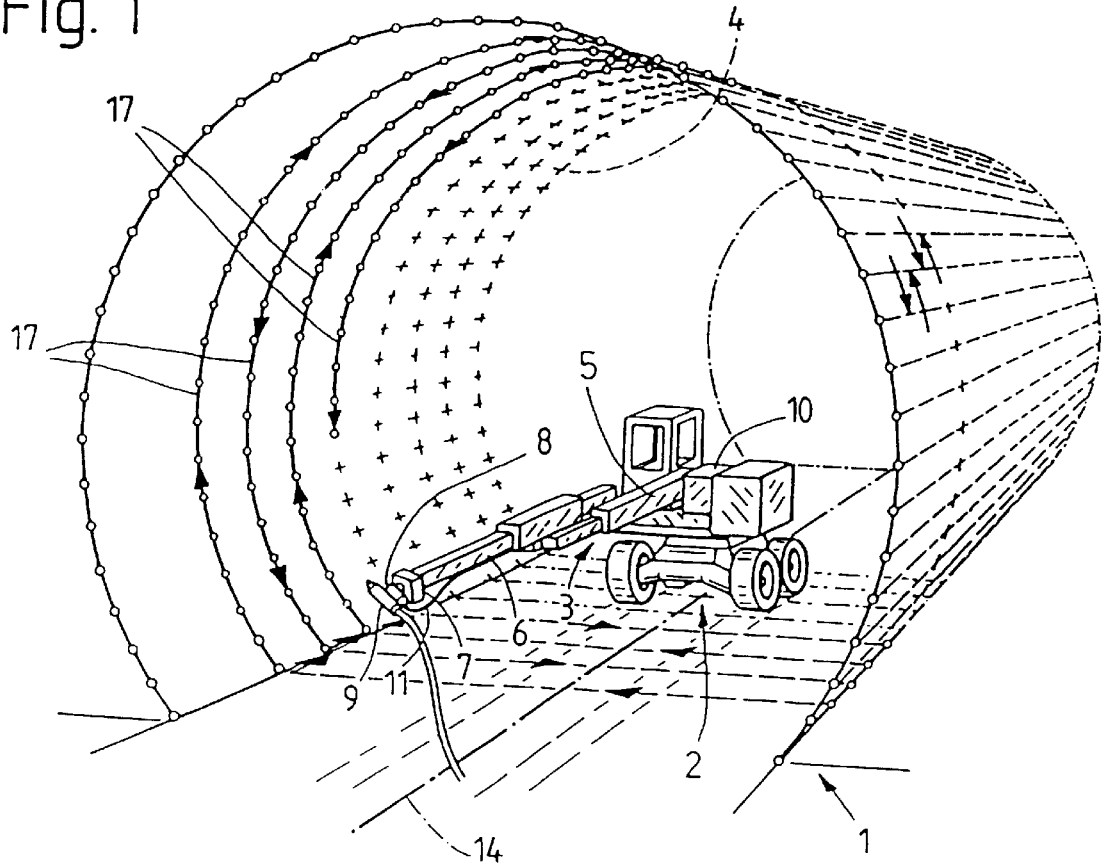
FIG. 1 shows a schematic illustration of an apparatus for spraying concrete whilst measuring a tunnel section.
Figure 2:
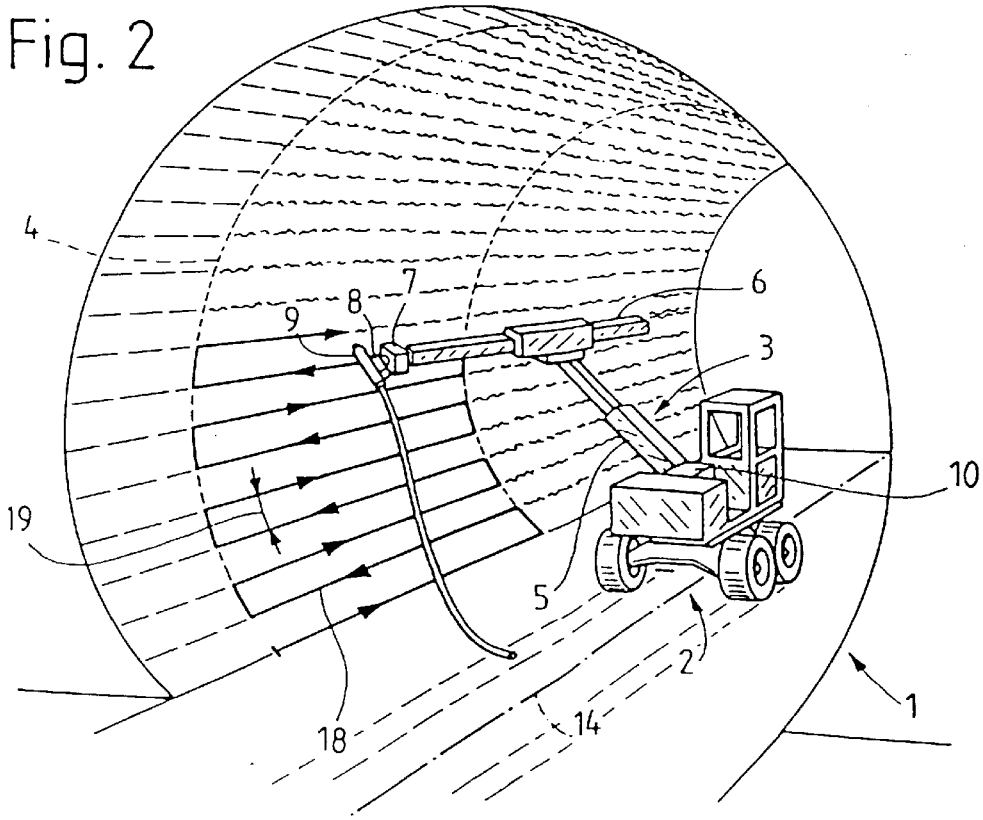
FIG. 2 shows the apparatus illustrated in FIG. 1 when spraying shotcrete on to the previously measured tunnel section.

FIGS. 1 and 2 show a schematic view of a tunnel 1, in which a wall section 4 of the tunnel 1 is coated with shotcrete by means of a spraying device 3 mounted on a vehicle (here an excavator chassis 2). In this case, the wall section 4 to be coated with one batch has a length of for example 1 to 6 meters.

The device 3 has an extendable spray lance 6 attached to a support arm 5 which is movable horizontally and vertically. This spray lance 6, as well as the support arm 5, may be moved in all directions by means of hinged supports which are not illustrated in detail.

At one end, the spray lance 6 additionally has a swivel head 7, which is movable about the axis of the spray lance 6. Attached to this swivel head 7 are a measuring probe 8 which serves to measure the tunnel section 4, and a spray nozzle 9 to apply the shotcrete. The measuring probe 8 employed may be, for example, an electric range finder which operates according to the principle of measuring travel time using an infra-red laser beam.

The device 3 also has an electronic control mechanism 10 illustrated by a block. This consists of a control switch having electric and/or electronic components to measure, control and regulate. The control switch is connected by electric leads not illustrated in the figures to the swivel head 7, the hinges and all other electrically and/or hydraulically drivable and controllable parts of the device 3, which can effect horizontal and/or vertical movements of the support arm 5, spray lance 6 or swivel head 7. As may be seen from FIG. 1, the control device 10 is additionally connected by a lead 11 to the measuring probe 8. In particular, the control switch has recording means and control means, so as to record the measurements determined during the measuring phase by the measuring probe 8 and to control the subsequent spray operation in a manner to be illustrated more fully, depending on the measurements determined. The control switch may have, for example, analog operational amplifiers, comparator circuits and the like and/or an analog/digital transformer and a digital computer. Finally, the switch mechanism may also have an indicator to indicate the measurements continuously during the measuring phase. The indicator may, for example, consist of an imaging screen to illustrate at least one section through the tunnel. Furthermore, the switch mechanism has input means which feed the required parameters of the process into the computer for the at least partly automatic measuring and spraying procedure.

Finally, the control mechanism 10 may also have a control box or the like, with which at least a few of the movements of the support arm 5, spray lance 6 or swivel head 7 can be carried out by means of manually-operable service elements, preferably with three-dimensionally-operating joysticks.

The control mechanism 10 is formed such that the progress of the concrete spraying process hereinunder described may be controlled as selected, either by manual operation of the service elements, partly or wholly, step by step by one person, or completely automatically by the control mechanism 10. It is envisaged that the large-scale processing of the shotcrete is controlled automatically all the time if possible, and that the process is only controlled "manually" by one person temporarily—for example to optimise the layer thickness to be applied.

Figure 3:
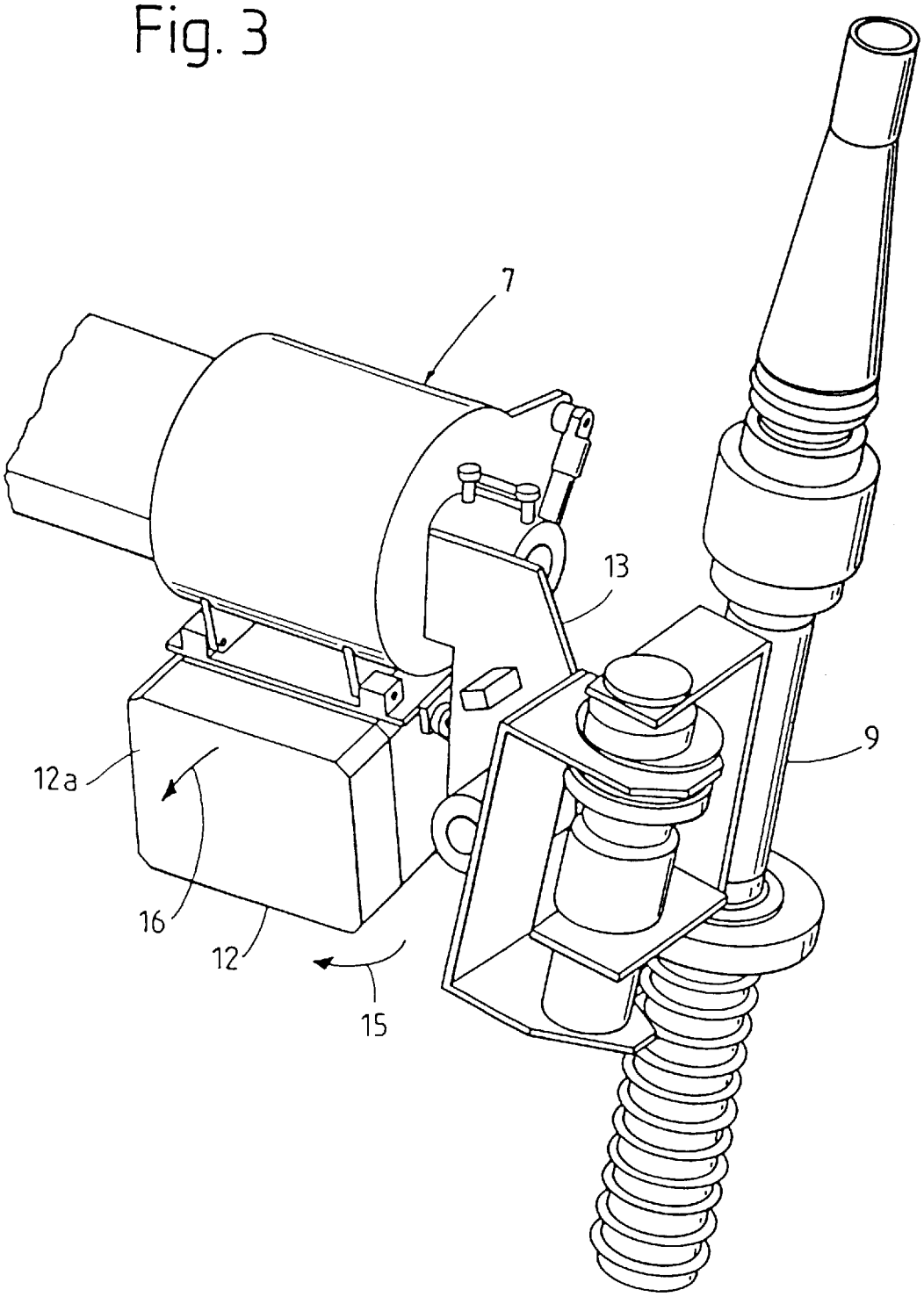
FIGS. 3 and 4 show a rotary head adjusted for swivelling movement on a spray lance, with spray nozzle and measuring probe fixed thereto.
Figure 4:
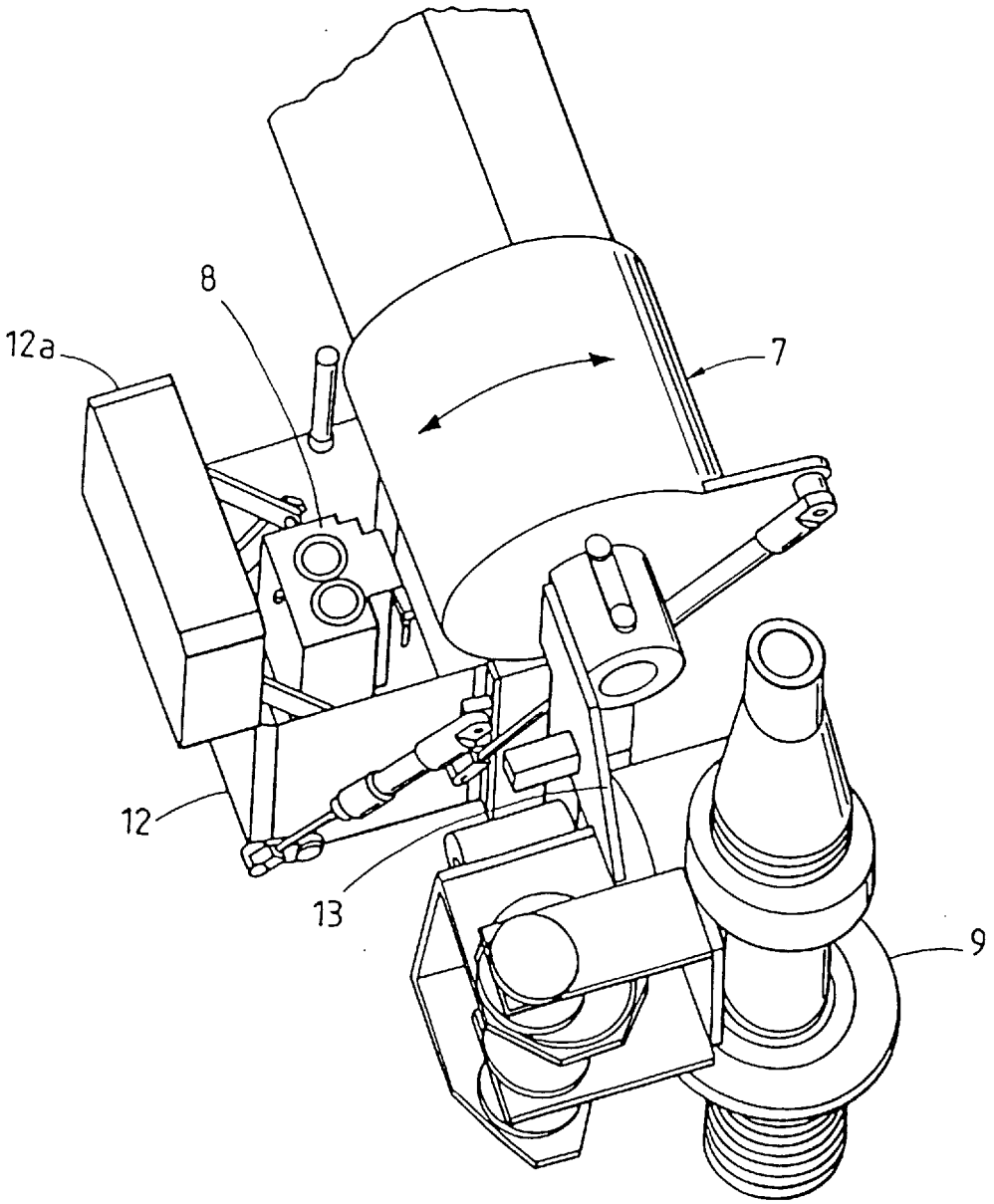

FIGS. 3 and 4 show one mode of mounting the spray nozzle 9 and the measuring probe 8 on the swivel head 7. As is illustrated in these figures, the measuring probe 8 is seated in a protective housing 12. In FIG. 3, it is covered by the lid 12*a* of the protective housing 12 (not visible). FIG. 3 shows the swivel head 7 in the "spray" state and FIG. 4 shows it in the "measuring" state.

As may similarly be seen from FIGS. 3 and 4, the support construction for the spray nozzle 9 is rigidly connected to the swivel head 7 via the swivel lever 13. Similarly, the measuring probe 8 is firmly connected to the swivel head 7 by the protective housing 12, so that the measuring probe 8 and the spray nozzle 9 can be rotated together about the axis of the spray lance 6. (The construction of the means of securing the spray nozzle 9 to the swivel lever 13 is not described in detail here, since this construction corresponds to the prior art and is not relevant to the function of the swivel head 7.)

If a layer of shotcrete is to be applied to a tunnel wall section 4 by the device illustrated in FIGS. 1 and 2, the device 3 with the carrier vehicle 2 is firstly positioned securely in the tunnel 1, preferably by means of supporting feet. The spray lance 6 of the device 3 is then aligned approximately coaxially to the tunnel axis 14 such that the whole wall section 4 to be coated with a batch of shotcrete may be covered by it.

The parameters which serve automatically to control the spray procedure are subsequently fed into the computer of the control switch by means of the said input means. These parameters include in particular

- feed capacity of the pump connected to the spray nozzle 9,
- the distance of the spray nozzle 9 from the inside wall of the tunnel,
- the thickness of the concrete layer to be attained,
- the diameter of the jet of concrete hitting the inside wall of the tunnel, the measuring grid serving to measure the inside wall of the tunnel, and the guide mechanism of support arm 5 and spray lance 6 for spraying the concrete.

The following combination of parameters may be pre-set for example to provide at least partly automatic control of the device 3; typical values are included:

Pump capacity: 15 $m^3/h$

Thickness of concrete layer to be attained: 250 mm

Distance of the spray nozzle 9 from the inside wall of the tunnel: 1500 mm

Diameter of jet of concrete: 500 mm

Measuring grid to measure the inside wall of the tunnel: 400×400 mm

Guide mechanism of the support arm 5 and the spray lance 6: horizontal, meandering After installing these preliminary settings, the protective housing 12 with the measuring probe 8 is pivoted in the direction of arrow 15, as illustrated in FIG. 3, the cover 12*a* is tilted in the direction of arrow 16 and the measuring probe 8 is thus brought to the measuring position in such a way that the measuring jet lies as parallel as possible to the axis of the spray nozzle. The ready-to-measure position which has now been set is illustrated in FIG. 4. Subsequently, the geometry of the wall section 4 is measured with the measuring probe 8, using a prescribed measuring grid, to which end the spray lance 6 is preferably pointed in a horizontal direction, coaxially to the tunnel axis 14. Measurement of the wall section 4, which has a length of approximately 3 to 6 m and is essentially formed by blasting out or cutting a tunnel abatement, may be effected with a measuring grid of 0.1×0.1 m to 1.0×1.0 m, but preferably with a measuring grid of 0.4×0.4 m, whereby when scanning and measuring the inside wall of the tunnel, measuring points are aimed at several points of the wall section 4; the distances thereof to the measuring probe 8 are measured and stored in the control mechanism 10. If—as in the embodiment depicted—the measuring probe 8 is guided along the gauge lines 17, measuring points are determined at intervals of 0.4 m, and after rotating the measuring probe 8 through 360°, they form together a full circle profile of the wall section 4. After measuring the first full circle profile, the spray lance 6 supporting the measuring probe 8 is shifted by 0.4 m parallel to the tunnel axis 14, and a further series of measurements is carried out. This procedure is repeated until the whole wall section 4 has been measured. Each measuring point determined by the measuring probe 8 is hereby essentially defined by three measurements, namely the distance of the measuring probe 8 from the inside wall of the tunnel, the angle enclosing the measuring probe 8 with the tunnel base, and the position of the measuring probe 8 in relation to the maximum or minimum deflection of the spray lance 6. These three values of measurement are stored in the computer memory of the control switch.

After measuring the wall section 4, the lid 12*a* of the protective housing 12 is snapped shut again, the protective housing 12 is tilted back to its starting position and the apparatus is thus ready for spraying.

If, in one batch, only a partial area of the wall section 4 is to be coated with shotcrete, the borders of this partial area must be defined prior to reaching the ready-for-spraying position. To this end, a visible laser beam from a measuring module coupled with the measuring probe 8 is guided for example with the assistance of service elements to at least three border points of the said partial area, with this beam the position of the border points is determined in relation to the deflection of the spray lance 6, and the positional values are stored in the computer memory of the control switch. (Of course, the edges of the partial area to be coated with a batch of shotcrete may also be defined simultaneously, i.e. during measurement of the wall section 4).

During the following spraying phase, the support arm 5, spray lance 6 and swivel head 7 are guided by the control mechanism 10 such that the center of the jet of concrete leaving the spray nozzle 9 is perpendicular, at least in places, to an area formed by three measurement points and that the distance of the spray nozzle from the said area corresponds to a pre-determined value. The spray nozzle 9 is hereby maintained at a distance of for example 1 to 3 meters, preferably 1.5 to 2.5 meters from the inside wall of the tunnel.

This spray procedure is essentially controlled as hereinafter described. First of all, the computer of the control switch calculates the actual spray procedure, i.e. the spherical curve serving to guide the spray nozzle, from the pre-determined values, the process parameters established in advance and the data on the optionally additionally defined partial area. The main requirement of the spray procedure is that the jet of concrete—as already mentioned—hits the surface of the inside wall of the tunnel at right angles as far as possible, and that the spray nozzle 9 where possible is held at the previously set spray distance from the inside wall of the tunnel.

Calculation of the spherical curve serving to guide the spray nozzle 9 may take place using various mathematical models. For example, a grid model covering the surface of the wall section 4 measured may be calculated from the measurements, whereby the spacing of the grid lines corresponds to the screen line spacing of the measuring screen established in advance. In this case, the spray nozzle 9 can be guided along by means of horizontally meandering lines 18, the constant spacing 19 of which corresponds as exactly as possible to the said grid line spacing.

To maintain the spray distance, the spherical curve is additionally calculated so that the center of the jet of concrete leaving the spray nozzle is perpendicular, at least in places, to an area formed by three points, and that the distance to the aforesaid area corresponds to the pre-determined value, of preferably about 1.5 to 2.5 m. Guidance of the spray nozzle 9 along the previously calculated spherical curve is undertaken by the control mechanism 10, whereby the jet position and the respective tunnel cross-section may be recorded on the screen of the recording device at any time.

During the spray procedure, the amount of concrete to be sprayed on to the inside wall of the tunnel is preferably constant per unit of time. However, it is conceivable for the amount of concrete to be sprayed onto the inside wall of the tunnel per unit of time to be varied by choice and depending on the data measured, for example in order to optimize the layer thickness in those areas of the inside wall of the tunnel which are more or less full of cracks.

Now that the general operation of the batch process has been described, the advantages of the invention will be clarified more fully.

With the process according to the invention, the correct angle of impact and the correct spray distance may be easily maintained, independently of the surface structure of the tunnel, so that an optimum quality of shotcrete is obtained.

With the device according to the invention, the spraying operation may be automated, which is important an important factor with larger construction work. Safety and general working conditions of the personnel are thereby substantially improved. Furthermore, after a spraying operation has taken place, with the process according to the invention the treated wall section can be measured again, so as to evaluate the wall thickness of the concrete wall thus formed and the amount of shotcrete which remains adhered to the surface.

It should, of course, be remembered out that the process described with the assistance of FIGS. 1 and 2 and the apparatus described in connection therewith represent only one embodiment of the invention and the skilled worker will readily appreciate that there are other embodiments which are possible and which still lie within the scope of the invention. For example, the device according to the invention may be mounted not only on an excavator chassis, as depicted, but on almost any suitable carrier vehicle normally found on construction sites. Similarly, FIGS. 3 and 4 only show a preferred embodiment of the invention. For example, it is not absolutely necessary for the spray nozzle 9 and the measuring probe 8 to be coupled together in the manner hereinabove described. An alternative (admittedly more expensive) is for the measuring head and the spray nozzle each to have a separate rotating drive.

In addition, instead of the preferred optical infra-red measuring probe 8, the device 3 may utilise another type of measuring probe, for example an ultrasonic measuring probe with an ultrasonic transmitter and an ultrasonic receiver to record ultrasonic waves reflected from the inside wall of the tunnel.

As far as the process according to the invention is concerned, in the above-described embodiment, the spray nozzle is guided during the spray procedure by the control mechanism such that the center of the jet of concrete leaving the spray nozzle is perpendicular, at least in places, to a plane formed by three measured points, and that the distance of the spray nozzle from this plane corresponds to a value determined in advance. Alternatively, the spray nozzle may be guided such that the center of the jet of concrete leaving the spray nozzle is, at least in places, perpendicular to a straight line formed by two measured points and that the distance of the spray nozzle to this straight line then corresponds to a value determined in advance.

Furthermore, prior to the above-described measuring phase, the position of the carrier vehicle supporting the device 3 can be determined in relation to the tunnel axis 14, and with the computer memory of the control mechanism 10, the specified profile of the wall section 4 to be obtained during the spray procedure may be defined and stored in a data bank of the computer. In this way, a mathematical comparison may be made between the measurements and the specified profile of the wall section 4 to be coated with shotcrete, and using this comparison, shallow points in the tunnel duct may be recognised and re-worked or re-profiled. Processes for determining the position of the carrier vehicle 2 in relation to the tunnel axis 14 are well known to the tunnel construction art.

Finally, the process according to the inventon may also be controlled by the control mechanism in such a way that the measuring and spraying phases take place simultaneously, so that even during a measuring phase, shotcrete is applied to a previously measured sector of a wall section.

We claim:

1. A process for batch coating of an inside surface of a tunnel section with a sprayable concrete composition, comprising the steps of:

providing a cement spraying apparatus having a control unit, and a spray lance having a spray nozzle and a measuring probe mounted on the spray lance, wherein the spray lance is displaceable along the length of the tunnel;

measuring a distance from the measuring probe to each of a first plurality of data points on the inside surface of the tunnel on a first vertical measuring plane perpendicular to the spray lance, and storing each of the measured distances within the control unit;

subsequently displacing the measuring probe a predetermined horizontal distance along the length of the tunnel;

measuring a distance from the measuring probe to each of at least a second plurality of data points on the inside surface of the tunnel on a second vertical measuring plane perpendicular to the spray lance, and storing each of the measured distances within the control unit;

after all measuring steps, subsequently;

spraying the concrete composition as a spray jet onto the inside surface of the tunnel section from the spray nozzle, the control unit adjusting positioning of the spray nozzle with respect to the inside surface of the tunnel such that the spray nozzle remains at a set distance from the surface, and the center of the spray jet is either perpendicular to and directed to be upon a straight line joining two adjacent data points, or, is perpendicular to and within a plane defined by three adjacent data points.

2. Process according to claim 1, characterised in that the measuring probe (8) produces an infra-red laser beam, and the inside surface of the tunnel section is measured with this laser beam.

3. Process according to claim 1 characterised in that during the spraying of concrete composition the spray nozzle is maintained at a distance of 1 to 3 meters at light angles to the inside wall of the tunnel.

4. Process according to claim 1, characterised in that a tunnel section having a length of 1 to 6 meters is measured prior to spraying.

5. A process for the batch coating of an inside surface of a tunnel section with a sprayable concrete composition according to claim 1 wherein:

the measuring probe is displaced from 0.1 to 1.0 meters along the length of the tunnel subsequent to measuring the first plurality of data points and prior to measuring the at least second plurality of data points.

6. A process for the batch coating of an inside surface of a tunnel section with a sprayable concrete composition according to claim 5, wherein:

the measuring probe is displaced from 0.4 to 1.0 meters along the length of the tunnel subsequent to measuring the first plurality of data points and prior to measuring the at least second plurality of data points.

7. A process for the batch coating of an inside surface of a tunnel section with a sprayable concrete composition according to claim 1 wherein;

the distance between adjacent data points of the first plurality of data points is from 0.1 to 1.0 meters.

8. A process for the batch coating of an inside surface of a tunnel section with a sprayable concrete composition according to claim 7 wherein;

the distance between adjacent data points of the first plurality of data points is from 0.4 to 1.0 meters.

9. A process for the batch coating of an inside surface of a tunnel section with a sprayable concrete composition according to claim 1 wherein;

the distance between adjacent data points of the at least second plurality of data points is from 0.1 to 1.0 meters.

10. A process for the batch coating of an inside surface of a tunnel section with a sprayable concrete composition according to claim 9 wherein;

the distance between adjacent data points of the at least second plurality of data points is from 0.4 to 1.0 meters.

11. A process forte batch coating of an inside surface of a tunnel section with a sprayable concrete composition according to claim 1 wherein;

the distance between adjacent data points of the first plurality of data points, and the distance between adjacent data points of the at least second plurality of data points is the same.

12. A process for the batch coating of an inside surface of a tunnel section with a sprayable concrete composition according to claim 11 wherein;

the distance between adjacent data points of the first plurality of data points, and the distance between adjacent data points of the at least second plurality of data points is from 0.1 to 1.0 meters.

13. A process for the batch coating of an inside surface of a tunnel section with a sprayable concrete composition according to claim 11 wherein;

the distance between adjacent data points of the first plurality of data points, and the distance between adjacent data points of the at least second plurality of data points is from 0.4 to 1.0 meters.

* * * * *

UNITED STATES PATENT AND TRADEMARK OFFICE

CERTIFICATE OF CORRECTION

PATENT NO. : 5,851,580

DATED : December 22, 1998

INVENTOR(S) : Felix AMBERG, Otto TSCHUMI and Markus VOGEL

It is certified that error appears in the above-identified patent and that said Letters Patent is hereby corrected as shown below:

On the title page at "[57] Abstract", in the first line, delete "shortcrete" and insert --shotcrete--.

Column 8, line 31, delete "light" and insert --right--.

Signed and Sealed this

Thirtieth Day of March, 1999

*Attest:*

*Attesting Officer*

Q. TODD DICKINSON

*Acting Commissioner of Patents and Trademarks*